US006907764B2

(12) United States Patent
Ushida

(10) Patent No.: US 6,907,764 B2
(45) Date of Patent: Jun. 21, 2005

(54) METHODS AND APPARATUS FOR MANUFACTURING FLANGED ARTICLES

(75) Inventor: Kouhei Ushida, Okazaki (JP)

(73) Assignee: Araco Kabushiki Kaisha (JP)

( * ) Notice: Subject to any disclaimer, the term of this patent is extended or adjusted under 35 U.S.C. 154(b) by 0 days.

(21) Appl. No.: 10/255,274

(22) Filed: Sep. 26, 2002

(65) Prior Publication Data

US 2003/0061855 A1 Apr. 3, 2003

(30) Foreign Application Priority Data

Sep. 28, 2001 (JP) ..... 2001-300399

(51) Int. Cl.[7] ..... B21D 28/10
(52) U.S. Cl. ..... 72/327; 72/377; 29/893.36
(58) Field of Search ..... 72/377, 324, 327, 72/329, 333, 336, 274, 356; 29/893.36, 893.32

(56) References Cited

U.S. PATENT DOCUMENTS 1,434,190 A * 10/1922 Bird ..... 72/329
2,654,944 A * 10/1953 Wilson ..... 29/893.34
5,068,964 A * 12/1991 Yabuno et al. ..... 29/892.3
5,152,061 A * 10/1992 Himmeroeder ..... 29/893.32
5,237,745 A 8/1993 Yamanaka
5,904,060 A * 5/1999 Kanemitsu et al. ..... 72/110
6,014,806 A 1/2000 Ohya
6,016,602 A 1/2000 Kanemitsu et al.
6,330,836 B1 * 12/2001 Watanabe et al. ..... 74/434

FOREIGN PATENT DOCUMENTS

JP 09-248626 9/1997
JP 10-202329 8/1998

* cited by examiner

*Primary Examiner*—Daniel C. Crane
(74) *Attorney, Agent, or Firm*—Patterson, Thuente, Skaar & Christensen, P.A.

(57) ABSTRACT

Methods for manufacturing a flanged article (21) that comprises a central depressed body (27) and a peripheral flange (23) may include press forming a material (10) in order to form an intermediate flanged article (20) that comprises a central depressed body (26) and a peripheral flange (22). Then, the peripheral flange of the intermediate flanged article may be circumferentially squeezed in order to thicken the peripheral flange due to plastic flow caused by plastic deformation. The press forming step optionally may include forming a toothed portion (24) on an inner surface (22*a*) of the peripheral flange. The squeezing step optionally may include reshaping the toothed portion. Apparatus (1, 2) for performing each of these method steps are also described.

16 Claims, 4 Drawing Sheets

METHODS AND APPARATUS FOR MANUFACTURING FLANGED ARTICLES

This application claims priority to Japanese Patent Application Serial Number 2001-300399, the contents of which are hereby incorporated by reference herein.

BACKGROUND OF THE INVENTION

1. Technical Field

The present invention relates to methods for manufacturing a flanged article from a sheet material. More particularly, the present invention relates to methods for manufacturing a flanged article from a sheet material by utilizing a press forming machine.

2. Related Art

A known method for manufacturing a flanged article is taught, for example, by Japanese Laid-open Patent Publication Number 10-202329, in which a toothed recessed plate or ratchet plate for a seat reclining device of a vehicle is exemplified as a flanged article that can be prepared utilizing the known method. In this known art, a disk-like sheet material or sheet blank is placed and clamped between upper and lower dies of a press forming machine. Thereafter, a punch associated with the upper die is lowered by a predetermined distance toward a corresponding die opening defined within the lower die. As a result, the sheet material is press formed or half die cut, to thereby form the ratchet plate that comprises a central depressed body and a peripheral flange. The peripheral flange of the ratchet plate is integrally connected to the central body via an annular shear deformed connecting portion. As a result, the peripheral flange and the central body define a circular open cavity or recess. Further, two tooth forming edges are circumferentially defined on the punch. Therefore, a pair of toothed portions can be formed on the inner circular surface of the peripheral flange when the sheet blank is press formed.

According to this known method, when the sheet material is half die cut by the punch, the sheet material is compressed and deformed along the periphery of the punch. As a result, the compressed sheet material may partly move towards the shear deformed connecting portion due to plastic flow, to thereby prevent the shear deformed connecting portion from cracking. However, the central body will have substantially the same thickness as the peripheral flange, which thickness is substantially equal to the thickness of the sheet material.

SUMMARY OF THE INVENTION

It is, accordingly, one object of the present teachings to provide improved methods and apparatus for manufacturing flanged articles.

In one embodiment of the present teachings, methods are taught for manufacturing a flanged article that comprises a central depressed body coupled to a peripheral flange. For example, a material (e.g., a sheet material or a sheet blank) may be press formed in order to form an intermediate flanged article that comprises a central depressed body and a peripheral flange. Then, the peripheral flange of the intermediate flanged article may be circumferentially squeezed in order to thicken the peripheral flange as a result of plastic flow caused by plastic deformation.

In another embodiment of the present teachings, at least one toothed portion may be formed on an inner surface of the peripheral flange when the intermediate flanged article is formed. Further, the toothed portion may be reshaped or raised when the peripheral flange is squeezed and thickened.

According to the present teachings, the peripheral flange of the intermediate flanged article may preferably be thickened, to thereby form the flanged article having the thickened peripheral flange. Therefore, a relatively think blank material can be utilized to form the flanged article, even if a relatively thicker peripheral flange is required. Consequently, manufacturing costs for preparing the flanged article can be reduced.

Other objects, features and advantages of the present invention will be ready understood after reading the following detailed description together with the accompanying drawings and the claims.

DETAILED DESCRIPTION OF THE INVENTION

Figure 1:
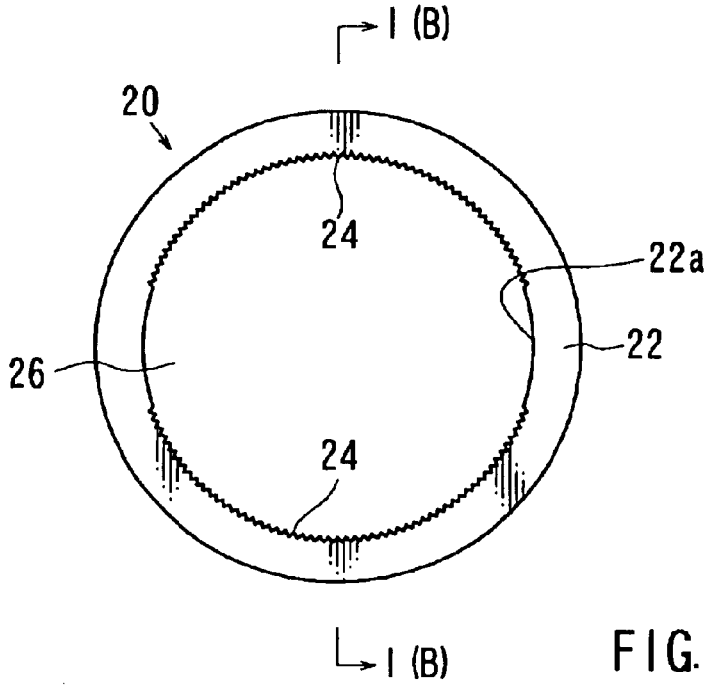
FIG. 1(A) is a plan view of an intermediate recessed plate according to one representative embodiment of the present teachings.
FIG. 1(B) is a cross-sectional view taken along line I(B)—I(B) in FIG. 1(A)
FIG. 1(C) is a partially enlarged view of FIG. 1(B)
Figure 1:
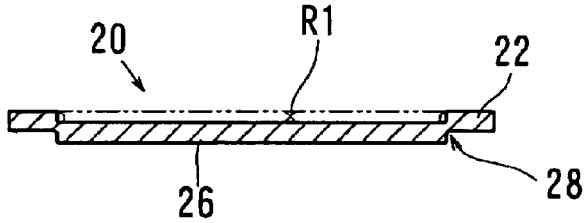
Figure 1:
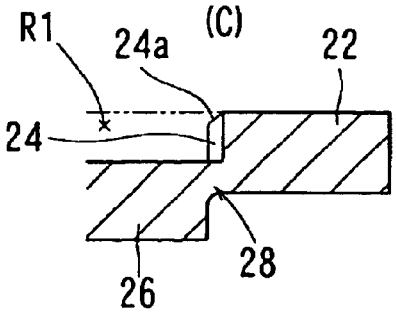

In one embodiment of the present teachings, an intermediate recessed plate is formed from a circular sheet material or sheet blank (e.g., a substantially flat material) by utilizing a shear press forming apparatus. For example, the sheet material (sheet blank) may be placed and clamped between upper and lower die assemblies of the press forming apparatus. Thereafter, a punch associated with an upper die or clamp ring of the upper die assembly is moved (e.g., lowered) toward a corresponding die opening defined within a lower die of the lower die assembly. As a result, the sheet material can be shear press formed or half die cut, to thereby form the intermediate recessed plate.

The intermediate recessed plate thus formed may have a dish-like shape and may comprise a central circular depressed body coupled to a peripheral flange. Preferably, the peripheral flange is integrally or continuously connected to the central body via an annular shear deformed connecting portion. Further, the peripheral flange and the central body may define a circular open cavity or recess.

Optionally, a pair of tooth forming edges may be circumferentially defined along the outer surface of the punch. In this case, a pair of toothed portions can be formed on an inner circular surface of the peripheral flange when the sheet blank is press formed in order to form the intermediate recessed plate.

The intermediate recessed plate thus formed may then be further processed by utilizing a squeezing apparatus, to thereby form a recessed plate. For example, the intermediate recessed plate may be clamped between upper and lower die assemblies of the squeezing apparatus. Thereafter, the upper die assembly may be moved (e.g., lowered) toward the lower die assembly, so that the intermediate recessed plate is pushed into a die opening defined within the lower die assembly. As a result, the peripheral flange of the intermediate recessed plate will be radially inwardly squeezed or compressed therein and will thicken due to plastic deformation. Thus, it is possible to produce the recessed plate having a thickened peripheral flange that is thicker than the peripheral flange of the intermediate recessed plate.

In each of the embodiments described above and below, the sheet material or sheet blank, which may preferably be a substantially flat material, preferably comprises a metal material. More preferably, the sheet material is substantially or entirely a metal material. In this case, the metal material is manipulated according to known cold press forming techniques. A preferred metal material for use with the present teachings is steel.

In another embodiment of the present teachings, apparatus for manufacturing a flanged article that comprises a central depressed body and a peripheral flange are also taught. For example, means (e.g., a press forming apparatus) may be provided for press forming a substantially flat material in order to form an intermediate flanged article that comprises a central depressed body and a peripheral flange. In addition, means (e.g., a squeezing apparatus) may be provided for circumferentially squeezing the peripheral flange of the intermediate flanged article. As a result, the peripheral flange will be thickened as a result of plastic flow caused by plastic deformation, such that the thickness of the peripheral flange will be thicker than the substantially flat material.

In another embodiment, means (e.g., a clamp) may be provided for clamping the peripheral flange of the intermediate flanged article between an upper die and a piston movably received within a lower die opening of the squeezing apparatus. Preferably, at least a portion of the peripheral flange extends outwardly from the upper die in the clamped state. Further, means (e.g., pressure pins) may be provided for pushing the upper die and the piston into the lower die opening together with the intermediate flanged article clamped therebetween. Optionally, a punch may clamp the central body of the intermediate flanged article between the punch and the piston.

In another embodiment, means (e.g., a punch having tooth forming edges) may be provided for forming a toothed portion on an inner surface of the peripheral flange. In addition or in the alternative, means (e.g., a tapered or chamfered guide surface) may be provided for reshaping or raising the toothed portion. In this case, the length of the toothed portion defined on the inner surface of the peripheral flange can be increased during the squeezing operation.

In another embodiment of the present teachings, apparatus are taught for manufacturing a flanged article that comprises a central depressed body and a peripheral flange. Such apparatus may include means (e.g., a clamp) for clamping a peripheral flange of an intermediate flanged article between an upper die and a piston movably disposed within a lower die opening of a squeezing apparatus. Preferably, at least a portion (i.e., an extended portion) of the peripheral flange outwardly extends from the lower die opening in the clamped state. Further, a punch may clamp a central body of the intermediate flanged article between the punch and the piston. In addition, means (e.g., pressure pins) may be provided for pushing the upper die and the piston into the lower die opening together with the intermediate flanged article clamped therebetween.

In another embodiment, a chamfered or tapered guide surface may be defined around the upper periphery of the lower die opening. The chamfered or tapered guide surface may serve to inwardly squeeze the extended portion in order to thicken the peripheral flange. As a result, the peripheral flange will be thickened during the squeezing operation.

Figure 2:
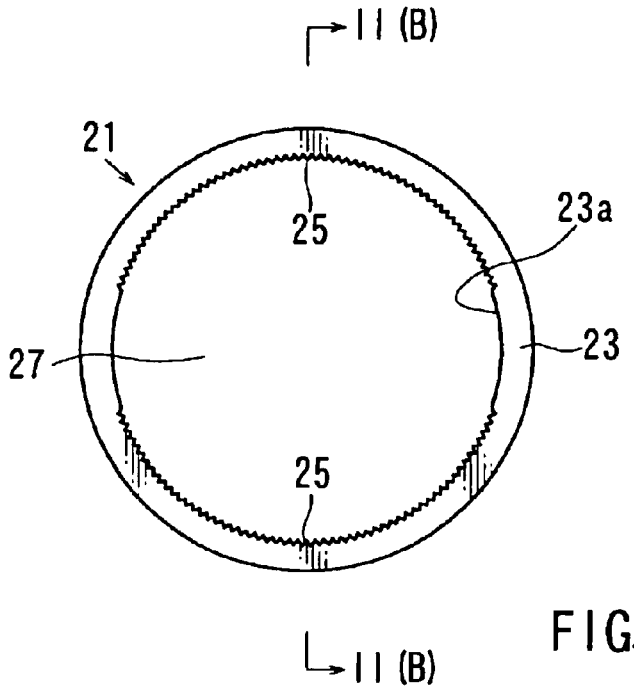
FIG. 2(A) is a plan view of a recessed plate according to another representative embodiment of the present teachings.
FIG. 2(B) is a cross-sectional view taken along line II(B)—II(B) in FIG. 2(A)
FIG. 2(C) is a partially enlarged view of FIG. 2(B)
Figure 2:
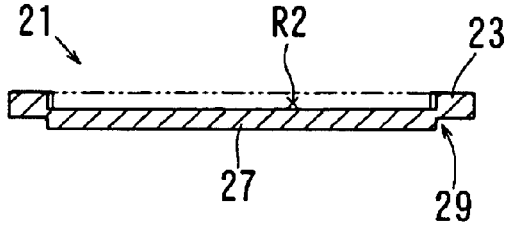
Figure 2:
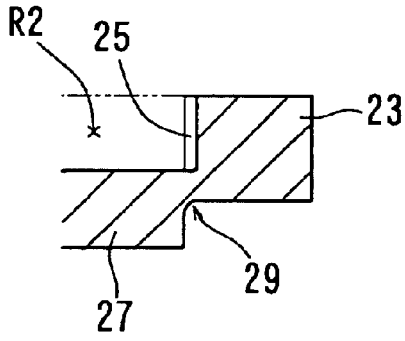
Figure 3:
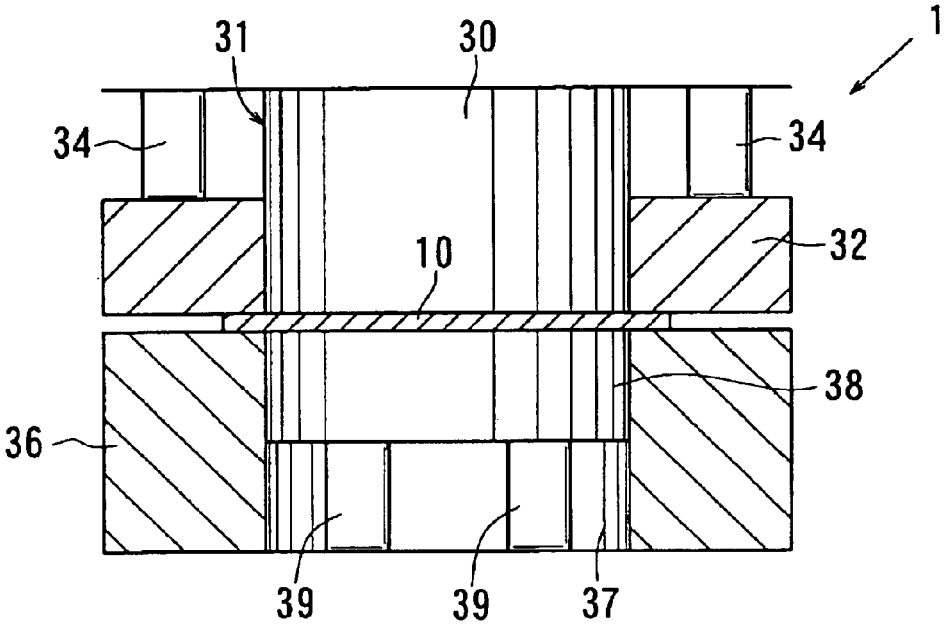
FIG. 3(A) is a vertical, cross-sectional view of an apparatus for manufacturing the intermediate recessed plate, illustrating a condition in which a sheet material is disposed between upper and lower dies of the apparatus.
FIG. 3(B) is a vertical, cross-sectional view of the apparatus, illustrating a condition in which the sheet material is press formed in order to form the intermediate recessed plate.
Figure 3:
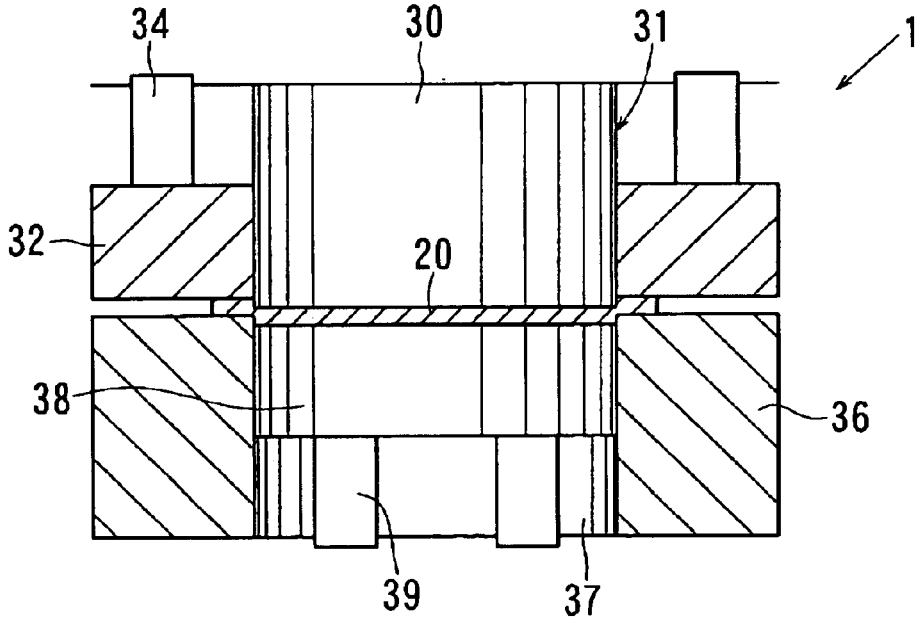
Figure 4:
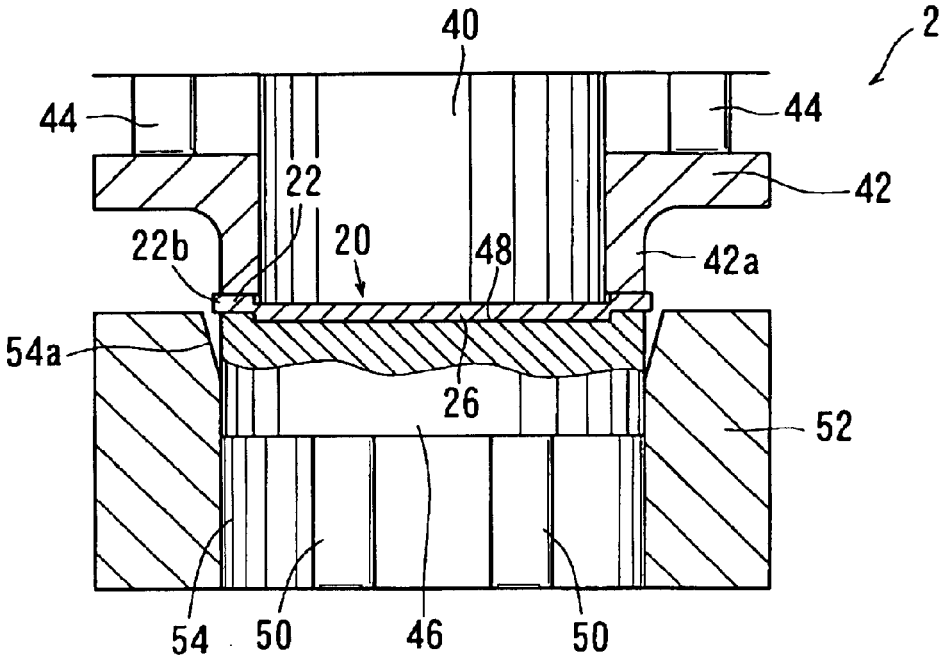
FIG. 4(A) is a vertical, cross-sectional view of an apparatus for manufacturing the recessed plate, illustrating a condition in which the intermediate recessed plate is disposed between upper and lower dies of the apparatus.
FIG. 4(B) is a vertical, cross-sectional view of the apparatus, illustrating a condition in which the intermediate recessed plate is squeezed in order to form the recessed plate.
Figure 4:
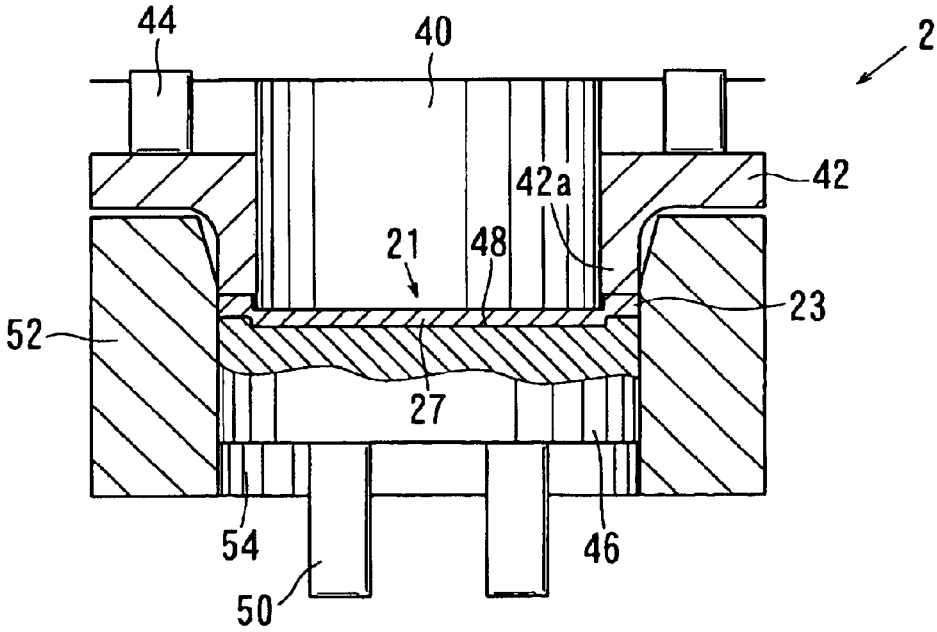

A detailed representative embodiment of the present teachings is shown in FIGS. 1(A) to 4(B), in which a circular dish-like toothed recessed plate 21 is exemplified in FIG. 2(A) as a flanged article that can be prepared utilizing the present teachings. The recessed plate 21 is preferably formed by processing a previously formed, intermediate toothed recessed plate 20, which is shown in FIG. 1. Further, such a recessed plate 21 may be utilized, e.g., with a housing that defines a locking mechanism for a vehicle seat reclining device.

As shown in FIGS. 1(A)–1(C), the intermediate recessed plate 20 as a primary product may preferably comprise a central circular depressed (offset) body 26 and a peripheral flange 22. The peripheral flange 22 is integrally and continuously connected to the central body 26 via an annular shear deformed connecting portion 28. Consequently, the inner surface of the peripheral flange 22 and top surface of the central body 26 define a circular open cavity or recess R1. In addition, two opposing toothed portions 24 are defined on an inner circular surface 22*a* of the peripheral flange 22. As shown in FIG. 1(C), the peripheral flange 22 may have substantially the same thickness as the central body 26.

As shown in FIGS. 2(A)–2(C), the recessed plate 21 as a secondary product (or final product) may preferably comprise a central circular depressed (offset) body 27 and a peripheral flange 23. The peripheral flange 23 is integrally and continuously connected to the central body 27 via an annular shear deformed connecting portion 29. As a result, the inner surface of the peripheral flange 23 and the top surface of the central body 27 define a circular open cavity or recess R1.

In addition, two opposing toothed portions 25 are defined on an inner circular surface 23*a* of the peripheral flange 23. As shown in FIG. 2(C), the peripheral flange 23 may have a thickness that is greater than the thickness of the central body 27. Moreover, the diameter of the peripheral flange 23 may be smaller than the diameter of the peripheral flange 22 of the intermediate recessed plate 20. Further, the thickness of the peripheral flange 23 may be thicker than the thickness of the peripheral flange 22.

The intermediate recessed plate 20 may be formed by utilizing a press forming apparatus 1. Thereafter, the intermediate recessed plate 20 is preferably processed by utilizing a squeezing apparatus 2, to thereby form the recessed plate 21.

As shown in FIGS. 3(A) and 3(B), the press forming apparatus 1 may include an upper die assembly that can move with respect to a lower die assembly. The upper die assembly may include an upper die or clamp ring 32 and a punch 30 that is movably disposed within the clamp ring 32.

Preferably, the punch 30 can move relative to the clamp ring 32 in the vertical direction (i.e., in the parallel direction), as shown in FIGS. 3(A) and 3(B). For example, the clamp ring 32 may be coupled to a plurality of hydraulically controlled pressure pins 34, so as to be normally biased or forced downwardly. The punch 30 may be coupled to a hydraulic cylinder (not shown), so as to independently move toward and away from the lower die assembly. Further, the punch 30 is preferably profiled so as to have substantially the same shape as the recess R1 that will be formed within the intermediate recessed plate 20. In addition, tooth forming edges 31 may be disposed around the circumference of the punch 30. The tooth forming edges 31 preferably correspond to opposing toothed portions 24 that will be formed along the inner circular surface 22*a* of the peripheral flange 22.

The lower die assembly may include an annular lower die 36 having a die opening 37 that preferably corresponds to the profile of the punch 30. The lower die assembly may further include an ejector plate 38 that is closely and movably received within the die opening 37. The ejector plate 38 may be coupled to a plurality of hydraulically controlled pressure pins 39, so as to be upwardly biased or forced. Preferably, the ejector plate 38 is designed so as to be normally coplanar with the lower die 36.

As shown in FIGS. 4(A) and 4(B), the squeezing apparatus 2 also may include an upper die assembly that can move with respect to a lower die assembly. The upper die assembly may include an upper die or clamp ring 42 and a punch 40 that is movably disposed within the clamp ring 42. Preferably, the punch 40 can move with respect to the clamp ring 42 in the vertical direction (i.e., in the parallel direction), as shown in FIGS. 4(A) and 4(B). The clamp ring 42 may be coupled to a plurality of hydraulically controlled pressure pins 44, so as to be downwardly biased. Also, the clamp ring 42 may include a lower leading end portion 42*a*, which portion 42*a* preferably has substantially the same diameter as the peripheral flange 23 of the recessed plate 21. The punch 40 may be coupled to a hydraulic cylinder (not shown), so as to be normally biased or forced downwardly.

Still referring to FIGS. 4(A) and 4(B), the lower die assembly may include an annular-shaped lower die 52 having a die opening 54 that may preferably correspond to the profile of the clamp ring leading end portion 42*a*. In addition, the upper periphery of the die opening 54 may be upwardly flared. As a result, an annular-shaped tapered (chamfered) guide surface 54*a* is defined around the upper periphery of the die opening 54. The lower die assembly may further include a pad or piston 46 that is closely and movably received within the die opening 54. The piston 46 may be coupled to a plurality of hydraulically controlled pressure pins 50, so as to be upwardly biased or forced. The piston 46 also may include a depressed portion 48 that is designed to closely receive the central body 26 of the intermediate recessed plate 20.

A representative method for manufacturing the recessed plate 21 using apparatuses 1 and 2 will now be described. As shown in FIG. 3(A), a circular sheet material 10 is first disposed on the lower die 36 and the ejector plate 38 of the lower die assembly. Subsequently, the upper die assembly is lowered, so that the periphery of the sheet material 10 is clamped between the lower die 36 and the clamp ring 32 of the upper die assembly.

Although the sheet material 10 may be formed by a variety of known methods, the sheet material 10 is preferably formed by stamping out a metal plate having a desired thickness. As noted above, the metal plate may preferably be a steel plate (e.g., a boron doped carbon steel plate) and known techniques for cold press forming may be utilized with the present teachings.

As shown in FIG. 3(B), the punch 30, which is movably received within the clamp ring 32, is then extended (e.g., lowered) toward the die opening 37 defined within the lower die 36. As a result, the sheet material 10 is shear press formed or half die cut, to thereby form the intermediate recessed plate 20 as the primary product. Further, when the sheet material 10 is press formed, the toothed portions 24 are simultaneously formed along the inner circular surface 22*a* of the peripheral flange 22, because tooth forming edges 31 are defined around the circumference of the punch 30.

If the ejector plate 38 is upwardly biased or forced during the press forming step, the punch 30 will be lowered against the upward reactive force of the ejector plate 38. Further, the punch 30 is preferably controlled in order to be lowered a predetermined distance, so that the connecting portion 28 will have the desired thickness. That is, persons skilled in the art can easily determine the predetermined distance for lowering the punch 30 in order to appropriate define the circular recess R1.

After completing the press forming operation, the punch 30 is retracted or withdrawn and then the upper die assembly is lifted or removed. As a result, the ejector plate 38 will be upwardly returned to its resting position due to the hydraulic force of the pressure pins 39. Further, the intermediate recessed plate 20 will be ejected from the die opening 37 of the lower die 36.

The intermediate recessed plate 20 thus formed comprises the central circular depressed body 26 and the peripheral flange 22 that are interconnected via the annular connecting portion 28. At this time, the circular body 26 and the peripheral flange 22 will have substantially the same thickness as the sheet material 10. The intermediate recessed plate 20 also includes the circular recess R1 that is defined by the peripheral flange 22 and the central body 26. In addition, two toothed portions 24 are formed around the inner circular surface 22*a* of the peripheral flange 22. Further, as best shown in FIG. 1(C), each of the toothed portions 24 may include a dull upper edge or shear drop 24*a* due to shearing.

The intermediate recessed plate 20 is then processed by utilizing the squeezing apparatus 2. That is, as shown in FIG. 4(A), the intermediate recessed plate 20 is placed or seated on the piston 46 of the lower die assembly such that the central body 26 is received within the depressed portion 48 of the piston 46. Subsequently, the upper die assembly is moved (e.g., lowered) toward the lower die assembly, so that the peripheral flange 22 will be clamped between the piston 46 and the clamp ring end portion 42*a*. In addition, the central body 26 will be clamped between the piston 46 and the punch 40. As shown in FIG. 4(A), the peripheral flange 22 preferably projects or extends radially outwardly from the piston 46 and the clamp ring end portion 42*a*. In this case, an annular extending portion 22*b* will be defined around the peripheral flange 22.

Thereafter, as shown in FIG. 4(B), the upper die assembly is further moved (e.g., lowered) toward the lower die assembly. Thus, the clamp ring end portion 42*a* and the punch 40 will be pushed into the die opening 54 together with the piston 46 against the hydraulic force of the pressure pins 50. At this time, the clamped intermediate recessed plate 20 is also pushed into the die opening 54 via the guide surface 54*a*. Consequently, the annular extending portion 22*b* of the peripheral flange 22 will be radially inwardly squeezed or compressed by the guide surface 54*a* and the peripheral flange 22 will thicken as a result of plastic flow caused by plastic deformation. Thus, the recessed plate 21 having the thickened peripheral flange 23 is produced as the secondary product or final product. Further, because some of the compressed material may move into the toothed portions 24 due to plastic flow when the annular extending portion 22*a* is compressed, the upper shear drops 24*a* of the toothed portions 24 are effectively reshaped, repaired and/or raised.

If the clamp ring 42 is forced or biased hydraulically downward and the piston 46 is forced or biased hydraulically upward (i.e., in the opposite direction), the intermediate recessed plate 20 can be reliably clamped or supported during the squeezing operation. Therefore, the connecting portion 28 may be effectively prevented from bending or deforming during the squeezing operation. Further, the hydraulic force of the pressure pins 44, which downwardly force or bias the clamp ring 42, may preferably be set such that the clamp ring 42 can be returned or upwardly moved when the peripheral flange 22 is thickened.

After completing the squeezing operation, the upper die assembly is returned to its resting position (e.g., upwardly lifted), so that the clamp ring 42 and the punch 40 can be removed from the die opening 54. At this time, the piston 46 is upwardly returned due to the hydraulic force of the pressure pins 50, to thereby eject the recessed plate 21 from the die opening 54 of the lower die 52.

The recessed plate 21 thus formed comprises the central circular depressed body 27 and the peripheral flange 23 that are interconnected via the annular connecting portion 29. The circular body 27 has the same thickness as the sheet material 10. However, the peripheral flange 23 has a thickness greater than the sheet material 10. In other words, the peripheral flange 23 has a thickness greater than the peripheral flange 22 of the intermediate recessed plate 20. Also, the recessed plate 21 includes the circular recess R2 that is deeper than the recess R1. In addition, the toothed portions 25 are defined around the inner circular surface 23*a* of the peripheral flange 23 and the toothed portions 25 are longer than the toothed portions 24. Further, as best shown in FIG. 2(C), none of the toothed portions 25 preferably has a dull upper edge or a shear drop due to the reshaping that occurs during the squeezing operation.

Optionally, the recessed plate 21 thus formed may be further treated or processed (e.g., restriking or coining) by utilizing one or more additional processing machines (not shown), to thereby produce a finally finished product. However, the recessed plate 21 also can be used as a final product without additional processing.

According to the present methods, the recessed plate 21 having the peripheral flange 23 may preferably be formed by squeeze thickening the peripheral flange 22 of the intermediate recessed plate 20. That is, it is possible to produce the recessed plate 21 having the thicker peripheral flange 23 from the thinner sheet material 10. Therefore, it is not necessary to use a thicker sheet material 10 even if the recessed plate 21 requires a relatively thick peripheral flange 23. As a result, it is possible to reduce manufacturing costs for the recessed plate 21 and to reduce the weight of the recessed plate 21.

A representative example of the present invention has been described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present teachings.

What is claimed is:

1. A method for manufacturing a flanged article that comprises a central depressed body and a peripheral flange, comprising:

press forming a substantially flat material to form an intermediate flanged article that comprises an intermediate central depressed body and an intermediate peripheral flange, and circumferentially squeezing the intermediate peripheral flange of the intermediate flanged article while applying a pressing force in a direction of thickness thereof, thereby forming the peripheral flange, wherein the intermediate peripheral flange is thickened as a result of plastic flow caused by plastic deformation, such that the peripheral flange is thicker than the intermediate peripheral flange and the central depressed body is coupled to the peripheral flange, wherein the intermediate flange of the intermediate flanged article is squeezed between an upper die and a piston movably received within a lower die opening of a squeeezing apparatus such that at least a portion of the intermediate peripheral flange extends outwardly from the lower die opening, and wherein the upper die and the piston are pushed into the lower die opening together with the intermediate flanged article clamped therebetween.

2. A method as defined in claim 1, wherein the squeezing step further comprises clamping the intermediate central body of the intermediate flanged article between a punch associated with the upper die and the piston.

3. A method for manufacturing a flanged article that comprises a central depressed body and a peripheral flange, comprising:

press forming a substantially flat material to form an intermediate flanged article that comprises an intermediate central depressed body and an intermediate peripheral flange, and circumferentially squeezing the intermediate flange of the intermediate flanged article, wherein the intermediate peripheral flange is thickened as a result of plastic flow caused by plastic deformation, such that the peripheral flange is thicker than the intermediate peripheral flange and the central depressed body is coupled to the peripheral flange, wherein the press forming step further comprises forming an intermediate toothed portion on an inner surface of the intermediate peripheral flange, and wherein the squeezing step further comprises clamping the intermediate peripheral flange of the intermediate flanged article between an upper die and piston movably received within a lower die opening of a squeezing apparatus, such that at least a portion of the intermediate peripheral flange extends outwardly from the lower die opening, pushing the upper die and the piston into the lower die opening together with the intermediate flanged article clamped therebetween, clamping the intermediate central body of the intermediate flanged article between a punch associated with the upper die and the piston, and reshaping or raising the intermediate toothed portion, thereby forming a longer toothed portion defined on an inner surface of the peripheral flange.

4. A method as in claim 3, wherein the substantially flat material comprises a metal plate.

5. A method as in claim 3, wherein the substantially flat material is a steel plate.

6. A method for manufacturing a flanged article that comprises a central depressed body and a peripheral flange, comprising:

press forming a substantially flat material to form a intermediate flanged article that comprises an intermediate central depressed body and an intermediate peripheral flange, and circumferentially squeezing the intermediate peripheral flange of the intermediate flanged article, wherein the intermediate peripheral flange is thickened as a result of plastic flow caused by plastic deformation, such that the peripheral flange is thicker than the intermediate paipheral flange and the central depressed body is coupled to the peripheral flange, wherein the press forming step further comprises forming an intermediate toothed portion on an inner surface of the intermediate peripheral flange, and wherein the squeezing step further comprises reshaping or raising the intermediate toothed portion, thereby forming a longer toothed portion defined on an inner surface of the peripheral flange.

7. A method for manufacturing a flanged article that comprises a central depressed body and a peripheral flange, comprising:

clamping an intermediate peripheral flange of an intermediate flanged article between an upper die and a piston movably disposed within a lower die opening of a squeezing apparatus, such that at least a portion of the intermediate peripheral flange outwardly extends from the lower die opening, clamping an intermediate central body of the intermediate flanged article between a punch associated with the upper die and the piston, and pushing the upper die and the piston into the lower die opening together with the intermediate flanged article clamped therebetween, thereby forming the flanged article comprising the central depressed body and the peripheral flange, wherein the intermediate peripheral flange is squeezed while a pressing force is applied in a direction of thickness of the intermediate peripheral flange.

8. A method as defined in claim 7, wherein a chamfered guide surface is defined around the upper periphery of the lower die opening and the pushing step further comprises inwardly squeezing the extending portion of the intermediate peripheral flange via the chamfered guide surface in order to thicken the intermediate peripheral flange, wherein the peripheral flange becomes thicker than the intermediate peripheral flange.

9. A method as in claim 8, wherein the intermediate flanged article comprises steel.

10. An apparatus for manufacturing a flanged article that comprises a central depressed body and a peripheral flange, comprising:

means for press forming a substantially flat material so as to form an intermediate flanged article that comprises an intermediate central depressed body and an intermediate perpheral flange, means for circumferentially squeezing the intermediate prepheral flange of the intermediate flanged article, and means for clamping the intermediate peripheral flange of the intermediate flanged article between an upper die and a piston movably received within lower die opening of the means for circumferentially squeezing the intermediate peripheral flange of the intermediate flanged article, the lower die being arranged and constructed such that at least a portion of the intermediate peripheral flange extends outwardly from the lower die opening, wherein the clamping means is arranged and constructed such that the intermediate peripheral flange is squeezed while a pressing force is applied in a direction of thickness of the intermediate peripheral flange, wherein the intermediate peripheral flange is thickened as a result of plastic flow caused by plastic deformation, such that the peripheral flange is thicker than the intermediate peripheral flange.

11. An apparatus as defined in claim 10, further comprising:

means for pushing the upper die and the piston into the lower die opening together with the intermediate flanged article clamped therebetween.

12. An apparatus as defined in claim 11, further comprises a punch arranged and constructed to clamp the intermediate central body of the intermediate flanged article between the punch and the piston.

13. An apparatus for manufacturing a flanged article that comprises a central depressed body and a peripheral flange, comprising:

means for press forming a substantially flat material so as to form an intermediate flanged article that comprises an intermediate central depressed body and an intermediate peripheral flange, means for circumferentially squeezing the intermediate peripheral flange of the intermediate flanged article, means for clamping the intermediate peripheral flange of the intermediate flanged article between an upper die and a piston movably received within lower die opening of the means for circumferentially squeezing the intermediate peripheral flange of the intermediate flanged article, the lower die being arranged and constructed such that at least a portion of the intermediate peripheral flange extends outwardly from the lower die opening, a punch arranged and constructed to clamp the intermediate central body of the intermediate flanged article between the punch and the piston, means for pushing the upper die and the piston into the lower die opening together with the intermediate flanged article clamped therebetween, means for forming an intermediate toothed portion on an inner surface of the intermediate peripheral flange, and means for reshaping or raising the intermediate toothed portion, thereby forming a longer toothed portion defined on an inner surface of the peripheral flange, wherein the intermediate peripheral flange is thickened as a result of plastic flow caused by plastic deformation, such that the peripheral flange is thicker than the intermediate peripheral flange.

14. An apparatus for manufacturing a flanged article that comprises a central depressed body and a peripheral flange, comprising:

means for press forming a substantially flat material so as to form an intermediate flanged article that comprises an intermediate central depressed body and an intermediate peripheral flange, means for circumferentially squeezing the intermediate peripheral flange of the intermediate flanged article, means for forming an intermediate toothed portion on an inner surface of the intermediate peripheral flange, and means for reshaping or raising the intermediate toothed portion, thereby forming a longer toothed portion defined on an inner surface of the peripheral flange, wherein the intermediate peripheral flange is thickened as a result of plastic flow caused by plastic deformation, such that the peripheral flange is thicker than the intermediate peripheral flange.

15. An apparatus for manufacturing a flanged article that comprises a central depressed body and a peripheral flange, comprising:

means for clamping an intermediate peripheral flange of an intermediate flanged article between an upper die and a piston movably disposed within a lower die opening of a squeezing apparatus, wherein the squeezing apparatus is arranged and constructed such that at least a portion of the intermediate peripheral flange outwardly extend from the lower die opening, a punch arranged and constructed to clamp an intermediate central body of the intermediate flanged article between the punch and the piston, and means for pushing the upper die and the piston into the lower die opening together with the intermediate flanged article clamped therebetween, whereby the flanged article comprising the central depressed body and the peripheral flange is formed, wherein the clamping means is arranged and constructed such that the intermediate peripheral flange is squeezed while a pressing force is applied in a direction of thickness of the intermediate peripheral flange.

16. An apparatus as defined in claim 15, wherein a chamfered guide surface is defined around the upper periphery of the lower die opening, the chamfered guide surface being arranged and constructed to inwardly squeeze the extending portion of the intermediate flanged article in order to thicken the intermediate peripheral flange, wherein the peripheral flange will be thicker than the intermediate peripheral flange.

* * * * *